US009394506B2

(12) United States Patent
Kalagher et al.

(10) Patent No.: US 9,394,506 B2
(45) Date of Patent: Jul. 19, 2016

(54) CLEANING COMPOSITION FOR HARD SURFACES

(71) Applicant: Prestone Products Corporation, Lake Forest, IL (US)

(72) Inventors: Thomas G. Kalagher, Torrington, CT (US); Colin Dilley, Thomaston, CT (US); Joseph Matthews, Danbury, CT (US)

(73) Assignee: Prestone Products Corporation, Lake Forest, IL (US)

( * ) Notice: Subject to any disclaimer, the term of this patent is extended or adjusted under 35 U.S.C. 154(b) by 0 days.

(21) Appl. No.: 14/622,274

(22) Filed: Feb. 13, 2015

(65) Prior Publication Data

US 2015/0225673 A1 Aug. 13, 2015

Related U.S. Application Data

(60) Provisional application No. 61/939,581, filed on Feb. 13, 2014.

(51) Int. Cl.

| | |
|---|---|
| ***C11D 1/00*** | (2006.01) |
| ***C11D 1/62*** | (2006.01) |
| ***C11D 1/835*** | (2006.01) |
| ***C11D 3/08*** | (2006.01) |
| ***C11D 3/26*** | (2006.01) |
| ***C11D 7/32*** | (2006.01) |
| ***C11D 3/04*** | (2006.01) |
| ***C11D 3/06*** | (2006.01) |
| ***C11D 3/10*** | (2006.01) |
| ***C11D 3/37*** | (2006.01) |
| *C11D 3/20* | (2006.01) |

(52) U.S. Cl.

CPC ..... *C11D 3/044* (2013.01); *C11D 3/046* (2013.01); *C11D 3/06* (2013.01); *C11D 3/10* (2013.01); *C11D 3/2003* (2013.01); *C11D 3/2079* (2013.01); *C11D 3/3742* (2013.01); *C11D 3/201* (2013.01); *C11D 3/2044* (2013.01); *C11D 3/2068* (2013.01)

(58) Field of Classification Search

CPC ..... C11D 1/00; C11D 1/62; C11D 1/835; C11D 3/08; C11D 3/162; C11D 3/2006; C11D 3/2041; C11D 3/26; C11D 3/373; C11D 7/32

See application file for complete search history.

(56) References Cited

U.S. PATENT DOCUMENTS

| | | | | |
|---|---|---|---|---|
| 6,881,711 | B1 * | 4/2005 | Gershun | C11D 3/044 510/179 |
| 6,903,064 | B1 | 6/2005 | Kasturi et al. | |
| 2006/0247143 | A1 * | 11/2006 | Gallagher | C11D 3/0078 510/180 |
| 2012/0276617 | A1 | 11/2012 | Jia et al. | |

OTHER PUBLICATIONS

Formasil* 593 Additive: Momentive Marketing Bulletin, 2011 (no month given), pp. 1-4.*

(Continued)

*Primary Examiner* — Brian P Mruk

(74) *Attorney, Agent, or Firm* — Gregory H. Zayia; Barnes & Thornburg LLP

(57) ABSTRACT

Compositions and methods for cleaning hard surfaces are disclosed herein. More particularly, the present disclosure relates to cleaning compositions that can be used in automotive applications for removing organic soils that accumulate on automotive surfaces without causing surface paint damage.

25 Claims, 4 Drawing Sheets

(56) References Cited

OTHER PUBLICATIONS

International Search Report and Written Opinion of PCT/US2015/15876 dated May 1, 2015.

Formasil* 593 additive; Momentive Marketing Bulletin (2011), 4 pages; retrieved on Apr. 10, 2015 at http://www.momentive.com/products/home.aspx?id=21498>.

* cited by examiner

CLEANING COMPOSITION FOR HARD SURFACES

CROSS REFERENCE TO RELATED APPLICATIONS

This application claims the benefit under 35 U.S.C. §119 (e) of U.S. Provisional Application No. 61/939,581, filed Feb. 13, 2014, the entire disclosure of which is hereby incorporated by reference.

BACKGROUND

Cleaning compositions for hard surfaces can be used in a variety of settings, including household or automotive applications. An effective cleaning composition, especially with respect to automotive applications, should be capable of removing a wide variety of materials including inorganic and organic soils. Typical inorganic soils include clay, cement, industrial dust, sand, products from acid rain condensation, rock forming minerals residue and the like. Typical organic soils include those derived from pollen, rubber, asphalt, oil residue, insect residue, tree sap, bird droppings and the like.

Traditional cleaning compositions typically suffer from a number of deficiencies. For example, such compositions generally contain the use of a high volatile organic compound ("VOC") content. However, it has been suggested that lowering the VOC content of traditional cleaning compositions limits their effectiveness and/or range of applications (e.g., are effective for use in light duty applications and not for removing organic soils from hard surfaces in automotive applications). Although they are satisfactory in removing inorganic soils from hard surfaces, traditional cleaners for automotive applications, are often unsatisfactory in removing organic soils. Further, cleaners that have a high VOC content may cause damage to the paint finish. Simply lowering the VOC content produces other deficiencies such as limited cleaning effectiveness especially for organic soils on hard surfaces.

SUMMARY

A cleaning composition in accordance with the present disclosure cleans hard surfaces and exhibits superior cleaning efficacy. A cleaning composition is effective for automotive applications, wherein the cleaning composition is used to remove, inhibit attachment, or prevent attachment of dirt, grime, bugs, and/or avian feces.

In an illustrative embodiment, a cleaner composition includes about 62 wt % to about 99.98 wt % water, about 0.005 wt % to about 0.5 wt % of a surfactant or surfactant mixture, zero to about 0.2 wt % of fragrance, zero to about 0.1 wt % of a dye, about 0.005 wt % to about 1 wt % of an ammonia compound, about 0.01 wt % to about 0.5 wt % of a water-dispersible alkyl amino, polyalkyleneoxide modified silicone terpolymer, and zero to about 42 wt % of at least one alcohol. In an embodiment, the zero to about 42 wt % of at least one alcohol includes zero to about 37 wt % of an alcohol that is a freezing point depressant such as methanol, ethanol, ethylene glycol, propylene glycol, or the like, or mixtures thereof.

In an illustrative embodiment, a cleaner composition includes about 98 wt % to about 99.9 wt % water, about 0.006 wt % to about 0.6 wt % of a surfactant or surfactant mixture, zero to about 0.12 wt % fragrance, zero to about 0.004 wt % of a dye, about 0.1 wt % to about 0.5 wt % of an ammonia compound, and about 0.025 wt % to about 0.2 wt % of a water-dispersible alkyl amino, polyalkyleneoxide modified silicone terpolymer.

DETAILED DESCRIPTION

Figure 1:
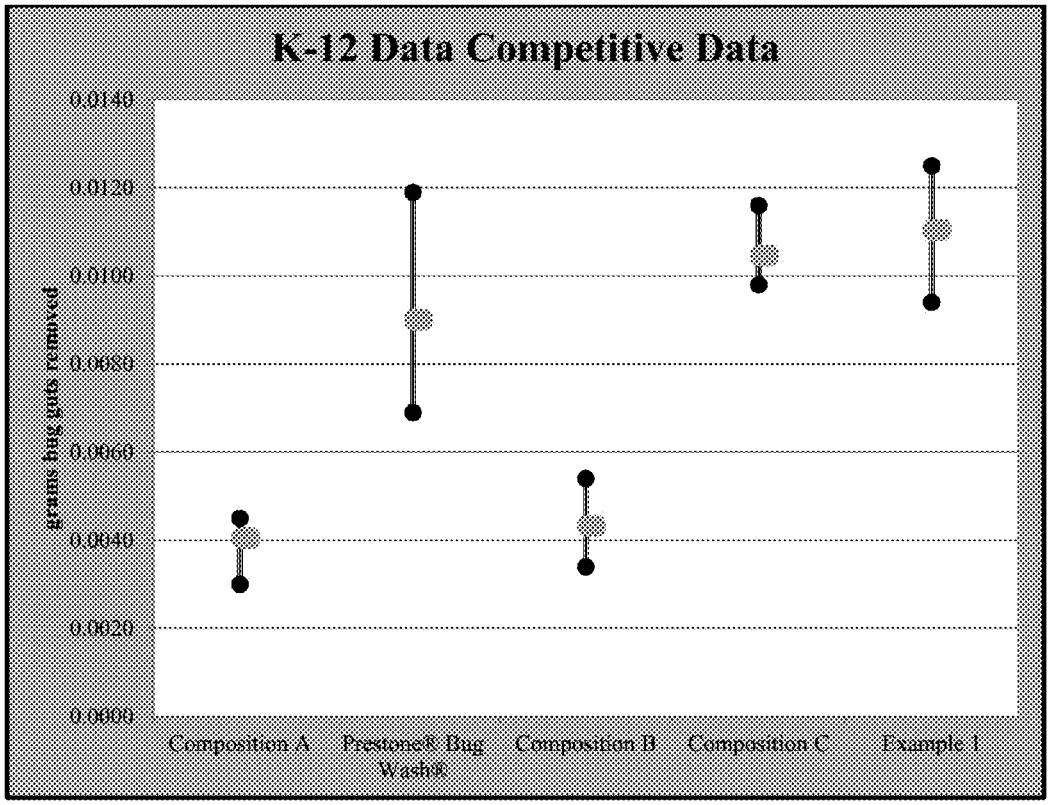
FIG. 1 shows the average grams of bug guts removed from a 22 mm×22 mm glass coverslip after application of various commercially available windshield fluid compositions and the formulation of Example 1.

Disclosed herein are embodiments of low VOC hard surface cleaning compositions that exhibit superior cleaning efficacy. Such cleaning compositions are particularly well suited for use in automotive applications to remove organic soils that accumulate on automotive surfaces without damaging a paint finish. Such cleaning compositions are environmentally safe and contain no or low amounts of VOCs.

In an embodiment, a cleaning composition includes water, at least one surfactant, an ammonia compound, and a defoamer. In an embodiment, a cleaning composition includes water, two or more surfactants, an ammonia compound, and a defoamer. In an embodiment, a cleaning composition includes water, at least one surfactant, an ammonia compound, and a water-dispersible alkyl amino, polyalkyleneoxide modified silicone terpolymer. In an embodiment, a cleaning composition includes water, two or more surfactants, an ammonia compound, and a water-dispersible alkyl amino, polyalkyleneoxide modified silicone terpolymer. In an illustrative embodiment, a cleaning composition includes a) water, b) at least one surfactant, c) an ammonia compound, d) a water-dispersible alkyl amino, polyalkyleneoxide modified silicone terpolymer, and e) a fragrance, a dye, or both a fragrance and a dye.

In an embodiment, a cleaning composition includes at least one surfactant. Suitable surfactants include, but are not limited to, nonionic surfactants, anionic surfactants, cationic surfactants, zwitterionic surfactants and mixtures thereof. Suitable surfactants include, but are not limited to, TRITON® X-100 (Union Carbide/Dow Chemical); POLY-TERGENT® (Olin Chemical); TERGITOL® (Union Carbide/Dow Chemical); PLURONIC® surfactants (BASF Wyandotte Corp.); IGEPAL® (GAF Corp.); DC silicone-glycol copolymers (Dow Corning Corp.); NEODOL® (Shell Chemical Co.); Diacid series from Westvaco Corporation, Lonzaine® CO (Lonza Chemical Co.), VELVETEX® (Henkel KGaA); Witcolate LCP and REWOTERIC® (Witco Chemical Co.); DEHYPOUND® HSC 5515 and GLUCOPON® from (Cognis Corp.); AO-14-2, Q-14-2, Tomadine 101 LF, Alkali Surfactant NM and Amphoteric L from Tomah Products, Inc; and mixtures thereof.

In an embodiment, a cleaning composition includes surfactant in an amount of about 0.001 wt % to about 0.25 wt %, about 0.001 wt % to about 0.2 wt %, about 0.001 wt % to about 0.1 wt %, about 0.001 wt % to about 0.075 wt %, 0.001 wt % to about 0.05 wt %, about 0.001 wt % to about 0.01, about 0.001 wt % to about 0.005 wt %, about 0.005% to about 0.25 wt %, about 0.005% to about 0.2 wt %, about 0.005% to about 0.1 wt %, about 0.005% to about 0.075 wt %, about 0.005% to about 0.05 wt %, about 0.005% to about 0.01 wt %, about 0.01% to about 0.075%, and about 0.01% to about 0.05%. In an embodiment, a cleaning composition includes a surfactant in an amount of about 0.25 wt %, about 0.2 wt %, about 0.1 wt %, about 0.075 wt %, about 0.05 wt %, about 0.04 wt %, about 0.03 wt %, about 0.02 wt %, about 0.01 wt %, about 0.005 wt %, or about 0.001 wt %.

Embodiments of a cleaning composition also include an ammonia compound. The term "ammonia compound" refers to a compound containing a $NH_2$, $NH_3$, or $NH_4^+$ group. Suitable ammonia compounds containing a $NH_4^+$ group include, but are not limited to, ammonium carbamate, ammonium carbonate, ammonium bicarbonate, ammonium hydroxide, ammonium acetate, ammonium borate, and ammonium phosphate. Suitable ammonia compounds containing a $NH_2$ group include, but are not limited to, alkanolamines having 1 to 6 carbon atoms (e.g., 1-amino-2-propanol). Ammonia is also a suitable ammonia compound. In an embodiment, a cleaning composition is free of alkanolamines. In an embodiment, a cleaning composition lacks 1-amino-2-propanol.

In an embodiment, a cleaning composition includes an ammonia compound in an amount of about 0.01% to about 0.5% (by weight of $NH_3$), about 0.01% to about 0.4%, about 0.01% to about 0.3%, about 0.01 wt % to about 0.25 wt %, about 0.01 wt % to about 0.2 wt %, about 0.01 wt % to about 0.1 wt %, about 0.01 wt % to about 0.075 wt %, 0.01 wt % to about 0.05 wt %, about 0.05 wt % to about 0.5 wt %, about 0.05 wt % to about 0.4 wt %, about 0.05 wt % to about 0.3 wt %, about 0.05 wt % to about 0.25 wt %, about 0.05 wt % to about 0.2 wt %, about 0.05 wt % to about 0.1 wt %, about 0.05 wt % to about 0.075 wt %, about 0.1 wt % to about 0.5 wt %, about 0.1 wt % to about 0.4 wt %, about 0.1 wt % to about 0.3 wt %, about 0.1 wt % to about 0.2 wt %, about 0.2 wt % to about 0.5 wt %, about 0.2 wt % to about 0.4 wt %, about 0.2 wt % to about 0.3 wt %, about 0.3 wt % to about 0.5 wt %, about 0.3 wt % to about 0.4 wt %, about 0.4 wt % to about 0.5 wt %, about 0.25 wt % to about 0.5 wt %, about 0.25 wt % to about 0.4 wt %, or about 0.25 wt % to about 0.3 wt %. In an embodiment, a cleaning composition includes a surfactant in an amount of about 0.5 wt %, about 0.4 wt %, about 0.3 wt %, about 0.25 wt %, about 0.2 wt %, about 0.1 wt %, about 0.075 wt %, about 0.05 wt %, or about 0.01 wt %

In an embodiment, a cleaning composition lacks alcohol (i.e., alcohol free).

In an illustrative embodiment, a cleaning composition may optionally include one or more additional additives. Such additives include, but are not limited to, dyes (e.g., "Alizarine Green" or "Uranine Yellow" from Abbey Color Inc.; "Chromatint Green X-1102" from Chromotech Inc.; "Acid Orange 7" or "Intraacid Rhodamine WT" (Acid Red 388) from Crompton & Knowles Corp; and "Acid Green" from BASF); fragrances (e.g., floral or tree oils, such as pine, rose oil, lilac, jasmine, wisteria, citrus such as lemon or orange, apple blossoms, compound bouquets, such as spice, woody, oriental and the like from Alfa Aromatics and Alpine Aromatics); antifoaming agents (e.g., PM-5150 from Union Carbide/Dow Chemical; SAG-2001 or Silwet® L-7220 from Witco Chemical Co.; Y-3D and DC-Q2-5067,1510-US, BOT or 454G-CTN from Dow Corning; PLURONIC® L-61 from BASF Corp.; PI-35150 from Ultra Additive; and Patco-492 or Patco 415 from American Ingredients Company); and/or thickening agents (e.g., CALAMIDE® C from Pilot Chemical Co.; CELLOSIZE Hydroxyethyl from Union Carbide/Dow; Crothix or Incromate ISML from Croda Inc.; Carbopols from BF Goodrich Co.; Jaguar HR-10S or Lapanite RDS/XLG from Southern Clay Products; Lipomic® 601 from Lipo Chemical Inc.; and Ninol® SR 100 from Stepan Company).

In an embodiment, a cleaning composition includes a defoamer. In an embodiment, a cleaning composition includes a defoamer, wherein the defoamer is a water-dispersible alkyl amino, polyalkyleneoxide modified silicone terpolymer (e.g., Formasil® 593, Momentive Performance Materials Inc., Columbus, Ohio). The inclusion of a water-dispersible alkyl amino, polyalkyleneoxide modified silicone terpolymer creates a thin layer on auto glass that alters the surface chemistry of the glass (i.e., decreases the contact angle between the glass and water forming beads). The same thin layer inhibits bugs from forming a bond with the glass (i.e., decreased sticking through altering the inter-surface forces), which makes bug removal easier.

In an embodiment, a cleaning composition includes a water-dispersible alkyl amino, polyalkyleneoxide modified silicone terpolymer in an amount of about 0.001 wt % to about 0.2 wt %, about 0.001 wt % to about 0.1 wt %, about 0.001 wt % to about 0.075 wt %, 0.001 wt % to about 0.05 wt %, about 0.001 wt % to about 0.01, about 0.001 wt % to about 0.005 wt %, about 0.005% to about 0.25 wt %, about 0.005% to about 0.2 wt %, about 0.005% to about 0.1 wt %, about 0.005% to about 0.075 wt %, about 0.005% to about 0.05 wt %, about 0.005% to about 0.01 wt %, about 0.01% to about 0.075%, and about 0.01% to about 0.05%. In an embodiment, a cleaning composition includes a water-dispersible alkyl amino, polyalkyleneoxide modified silicone terpolymer in an amount of about 0.2 wt %, about 0.1 wt %, about 0.09 wt %, about 0.08 wt %, about 0.075 wt %, about 0.07 wt %, about 0.06 wt %, about 0.05 wt %, about 0.04 wt %, about 0.03 wt %, about 0.02 wt %, about 0.01 wt %, about 0.005 wt %, or about 0.001 wt %.

In an embodiment, a cleaner composition includes water in an amount of about 99.9 wt %, about 99.8 wt %, about 99.7 wt %, about 99.6 wt %, about 99.5 wt %, about 99.4 wt %, about 99.3 wt %, about 99.2 wt %, about 99.1 wt %, about 99 wt %, about 98.9 wt %, about 98.8 wt %, about 98.7 wt %, about 98.6 wt %, about 98.5 wt %, about 98.4 wt %, about 98.3 wt %, about 98.2 wt %, about 98.1 wt %, about 98 wt %, about 98.5 wt %, or about 97 wt %. In an embodiment, a cleaner composition includes water in an amount of about 99.0 wt % to about 99.9 wt %, 99.0 wt % to about 99.8 wt %, 99.0 wt % to about 99.7 wt %, 99.0 wt % to about 99.6 wt %, 99.0 wt % to about 99.5 wt %, 99.0 wt % to about 99.4 wt %, about 99.0 wt % to about 99.3 wt %, 99.1 wt % to about 99.9 wt %, 99.1 wt % to about 99.8 wt %, 99.1 wt % to about 99.7 wt %, 99.1 wt % to about 99.6 wt %, 99.1 wt % to about 99.5 wt %, 99.1 wt % to about 99.4 wt %, about 99.1 wt % to about 99.3 wt %, 99.2 wt % to about 99.9 wt %, 99.2 wt % to about 99.8 wt %, 99.2 wt % to about 99.7 wt %, 99.2 wt % to about 99.6 wt %, 99.2 wt % to about 99.5 wt %, 99.2 wt % to about 99.4 wt %, about 99.2 wt % to about 99.3 wt %, 99.3 wt % to about 99.9 wt %, 99.3 wt % to about 99.8 wt %, 99.3 wt % to about 99.7 wt %, 99.3 wt % to about 99.6 wt %, 99.3 wt % to about 99.5 wt %, 99.3 wt % to about 99.4 wt %, 99.4 wt % to about 99.9 wt %, 99.4 wt % to about 99.8 wt %, 99.4 wt % to about 99.7 wt %, 99.4 wt % to about 99.6 wt %, or 99.4 wt % to about 99.5 wt %. In an embodiment, a cleaner composition includes water in an amount of about 62 wt % to about 99.9 wt %, about 65 wt % to about 99.9 wt %, about 70 wt % to about 99.9 wt %, about 75 wt % to about 99.9 wt %, about 80 wt % to about 99.9 wt %, about 85 wt % to about 99.9 wt %, about 90 wt % to about 99.9 wt %, about 91 wt % to about 99.9 wt %, about 92 wt % to about 99.9 wt %, about 93 wt % to about 99.9 wt %, about 94 wt % to about 99.9 wt %, about 95 wt % to about 99.9 wt %, about 96 wt % to about 99.9 wt %, about 97 wt % to about 99.9 wt %, about 98 wt % to about 99.9 wt %, or about 98.5 wt % to about 99.9 wt %.

In an embodiment, a composition cleaner is formulated for winter (i.e., cold weather). In an embodiment, a winter formulation includes at least one alcohol that is a freezing point depressant. Exemplary alcohols include monohydric or polyhydric alcohols and mixtures thereof. The alcohol can be selected from the group consisting of methanol, ethanol, propanol, butanol, furfurol, furfuryl alcohol, tetrahydrofurfuryl alcohol, ethoxylated furfuryl alcohol, ethylene glycol, propylene glycol, 1,3-propanediol, glycerol, diethylene glycol, triethylene glycol, 1,2-propylene glycol, 1,3-propylene glycol, dipropylene glycol, butylene glycol, glycerol-1,2-dimethyl ether, glycerol-1,3-dimethyl ether, monoethylether of glycerol, sorbitol, 1,2,6-hexanetriol, trimethylolpropane, alkoxy alkanols such as methoxyethanol, and combinations of two or more of the foregoing.

In an embodiment, a composition cleaner may include about 0 wt % to about 5 wt % of a polyhydric alcohol. In an embodiment, a composition cleaner may include about 0 wt %, about 1 wt %, about 2 wt %, about 3 wt %, about 4 wt %, or about 5 wt % of a polyhydric alcohol. In an embodiment, a composition cleaner lacks a polyhydric alcohol. In an embodiment, the polyhydric alcohol can be ethylene glycol, propylene glycol, or the like, and mixtures thereof.

In an embodiment, a cleaner composition includes about 0 wt % to about 37 wt % of a monohydric alcohol. In an embodiment, a cleaner composition includes about 20 wt % to about 37 wt %, about 25 wt % to about 37 wt %, about 30 wt % to about 37 wt %, about 20 wt % to about 35 wt %, about 25 wt % to about 35 wt %, about 30 wt % to about 35 wt %, about 20 wt % to about 30 wt %, or about 25 wt % to about 30 wt % of a monohydric alcohol. In an embodiment, a composition cleaner lacks (is free of) a monohydric alcohol. In an embodiment, the monohydric alcohol can be methanol or ethanol.

In an illustrative embodiment, a cleaner composition includes about 62 wt % to about 99.98 wt % water, about 0.005 wt % to about 0.5 wt % of a surfactant or surfactant mixture, zero to about 0.2 wt % of fragrance, zero to about 0.1 wt % of a dye, about 0.005 wt % to about 1 wt % of an ammonia compound, about 0.01 wt % to about 0.5 wt % of a water-dispersible alkyl amino, polyalkyleneoxide modified silicone terpolymer, and zero to about 42 wt % of at least one alcohol. In an embodiment, the zero to about 42 wt % of at least one alcohol includes zero to about 37 wt % of an alcohol that is a freezing point depressant such as ethylene glycol, propylene glycol, or the like. In an illustrative embodiment, a cleaner composition includes about 98 wt % to about 99.9 wt % water, about 0.006 wt % to about 0.6 wt % of a surfactant or surfactant mixture, zero to about 0.12 wt % fragrance, zero to about 0.004 wt % of a dye, about 0.1 wt % to about 0.5 wt % of an ammonia compound, and about 0.025 wt % to about 0.2 wt % of a water-dispersible alkyl amino, polyalkyleneoxide modified silicone terpolymer.

Illustrative embodiments also include methods for cleaning hard surfaces. In one embodiment, a cleaning method comprises applying a cleaning composition described herein to a hard surface, and wiping the surface. In one embodiment, a cleaning method comprises applying a cleaning composition described herein to a hard surface, and rinsing the surface.

In an embodiment, a method for preventing bug attachment to a hard surface includes pretreating a hard surface with a cleaning composition. In an embodiment, a method for preventing bug attachment to a hard surface includes applying a cleaning composition to a clean hard surface prior to use of the hard surface (e.g., driving an automobile comprising the hard surface). In an embodiment, a method for inhibiting bug attachment to a hard surface includes pretreating a hard surface. In an embodiment, the hard surface is a windshield.

In an embodiment, a method for preventing dirt attachment to a hard surface includes pretreating a hard surface. In an embodiment, a method for preventing dirt attachment to a hard surface includes applying a cleaning composition to a clean hard surface prior to use of the hard surface (e.g., driving an automobile comprising the hard surface). In an embodiment, a method for inhibiting dirt attachment to a hard surface includes pretreating a hard surface. In an embodiment, the hard surface is a windshield.

In an embodiment, a method for preventing avian feces attachment to a hard surface includes pretreating a hard surface. In an embodiment, a method for preventing avian feces attachment to a hard surface includes applying a cleaning composition to a clean hard surface prior to use of the hard surface (e.g., driving an automobile comprising the windshield). In an embodiment, a method for inhibiting avian feces attachment to a hard surface includes pretreating a hard surface. In an embodiment, the hard surface is a windshield.

In an embodiment, a method of producing a cleaning composition includes adding a water-dispersible alkyl amino, polyalkyleneoxide modified silicone terpolymer to an existing cleaning composition, wherein the final amount of the water-dispersible alkyl amino, polyalkyleneoxide modified silicone terpolymer is about 0.01 wt % to about 1 wt % about 0.01 wt % to about 0.5 wt %.

In an embodiment, a method includes diluting a cleaning composition concentrate to produce a cleaning composition as disclosed herein. In an embodiment, a method includes diluting a cleaning composition concentrate to produce a cleaning composition comprising about 62 wt % to about 99.98 wt % water, about 0.005 wt % to about 0.5 wt % of a surfactant or surfactant mixture, zero to about 0.2 wt % of fragrance, zero to about 0.1 wt % of a dye, about 0.005 wt % to about 1 wt % of an ammonia compound, about 0.01 wt % to about 0.5 wt % of a water-dispersible alkyl amino, polyalkyleneoxide modified silicone terpolymer, and zero to about 42 wt % of at least one alcohol. In an embodiment, a method includes diluting a cleaning composition concentrate to produce a cleaning composition comprising about 98 wt % to about 99.9 wt % water, about 0.006 wt % to about 0.6 wt % of a surfactant or surfactant mixture, zero to about 0.12 wt % fragrance, zero to about 0.004 wt % of a dye, about 0.1 wt % to about 0.5 wt % of an ammonia compound, and about 0.025 wt % to about 0.2 wt % of a water-dispersible alkyl amino, polyalkylene oxide modified silicone terpolymer.

In an embodiment, any of the methods disclosed herein further comprise wiping the hard surface with a cloth, a squeegee, a windshield wiper, or the like. In an embodiment, any of the methods disclosed herein further comprise rinsing the hard surface with water or another liquid to facilitate removal of dirt, bugs, etc. after applying the cleaning composition.

The compositions and methods of this invention are preferably used in automotive applications to remove organic soils from automotive surfaces, and more preferably, to remove organic soils from windshields. The compositions and methods of this invention provide effective cleaning of organic soils without damaging the surface being cleaning or the surrounding surface including the paint finish.

On a surface, fluids will bead on a hard surface (e.g., water on a windshield). The angle between the contact point of the fluid with the hard surface forms the "contact angle." The contact angle can be measured using a goniometer. For example, the contact angle for a water droplet on a flat glass surface is about 68 to 69 degrees. Pretreating a hard surface with a cleaning composition as disclosed herein can change this angle when fluid beads on the hard surface. Consequently, pretreating a flat surface of glass with a cleaning composition as described herein increases the contact angle with a water droplet. In an embodiment, a contact angle following pretreatment (applying a cleaning composition as disclosed herein) increases the contact angle for a water droplet. In an embodiment, a method comprises pretreating glass with a cleaning composition as disclosed herein, which increases the contact angle for a water droplet to about 75, 76, 77, 78, 79 80, 81, 82, 83, 84, or 85 degrees. In an embodiment, a method comprises pretreating glass with a cleaning composition as disclosed herein, which increases the contact angle for a water droplet to about 75 to about 78, 79, 80, 81, 82, 83, 84, or 85 degrees; about 76 to about 78, 79, 80, 81, 82, 83, 84, or 85 degrees; or about 77 to about 78, 79, 80, 81, 82, 83, 84, or 85 degrees. An increase in a contact angle increases the height of a droplet, thereby, making the droplet easier to remove via wiping (e.g., cloth, windshield wiper, squeegee, etc.).

As used herein, the term "hard surfaces" includes glass surfaces and automotive surfaces. As used herein, the term "automotive surface" includes windshields, fenders, tires, doors, roof, hood, trunk, bumpers, trim, windows, hub caps, transportation body and heat exchangers. As used herein, the term "automotive application" includes trains, motorcycles, cars, airplanes, boats, trucks, buses and recreational sporting vehicles and related equipment (e.g., helmets).

As used herein, the term "bug guts" refers to any liquid remnant of any type of bug. As an example, a bug such as a lovebug will collide with an automobile's windshield thereby producing a splatter. Some of the splatter is solid and some is liquid. This liquid remnant of a bug can splatter or streak across an automobile's windshield, grill, hood, etc.

EXAMPLES

Example 1

Formulation

| | wt % |
|---|---|
| Softened Water | 99.58285 |
| Witcolate WAC LA | 0.01000 |
| Dehypound ® Advanced | 0.04000 |
| Citrus Storm | 0.01500 |
| Sensient Green Dye | 0.00215 |
| Ammonium Hydroxide | 0.30000 |
| Formasil ® 593 | 0.05000 |
| Totals | 100.00000 |

The cleaning composition included two surfactants: Witcolate WAC LA (a sodium lauryl sulfate acquired from AkzoNobel Chemicals, Pasadena, Calif.) and Dehypound® Advanced (Caprylyl/Decyl Gluco side (and) Deceth-5 (and) PPG-6-Laureth-3, a blend of nonionic surfactants acquired from BASF Corp.).

Example 2

K-12 Tensiometer Testing

K12 tensiometer provides a quantitative evaluation of soil removal, by weight loss, of windshield washer formulae. Four commercially available windshield washer fluids and the formulation from Example 1 were tested.

Methods

Surface Tension

In order to run the contact angle of a fluid on a test substrate, the surface tension of the fluid must be known. Each sample is tested three times and an average is taken.

Fluid and Equipment Preparation Procedure

Using a graduated cylinder, 100 ml of windshield washer fluid compositions were poured into a 130 ml glass schott dish, which was placed in the lowered tensiomat stage. The balance arm was fastened, and the platinum plate was flamed using a propane torch. The plate was positioned into the secured balance arm, which was unfastened. The platinum plate was positioned less than 1/16 inch from the liquid surface by raising the tensiomat stage. The tensiomat doors were closed.

Fluid Density Procedure

A 100 ml volumetric flask was tared on an analytical balance and then subsequently filled with the test fluid to the mark on the neck of the flask. The mass of the fluid from the balance was recorded, and the fluid density was calculated by dividing the fluid mass by the fluid volume.

Cricket Slide Preparation

Ethanol was sprayed into the container of crickets and the container was sealed until all crickets were euthanized. The container was then opened and the remaining ethanol was allowed to evaporate.

A cricket slurry was prepared by adding 5.00+/−0.10 grams of crickets to a small blender, which was run for 30 seconds. 20 ml of deionized water was to the blender and run for another 30 seconds. The cricket slurry was transferred to a centrifuge tube and centrifuged for 20 minutes at 2000 rpm. The top and middle supernatant layers were removed transferred to a small glass beaker and the bottom supernatant layer was discarded.

The slurry was used to prepare glass slides. Measurements of 9 mm from the bottom of a 22 mm by 22 mm glass cover slip were marked on both sides with a fine tip sharpie and a reference number in the corner. Each cover slip was weighed on an analytical balance, and the mass was recorded. Electrical tape was laid across the glass slide so the bottom of the tape meets at the 9 mm mark on both sides of the slide. This left a 198 $mm^2$ area exposed to be filled with cricket slurry. Enough cricket slurry was added to increase the mass of the cover slip by 0.0100 grams when dried (approximately 16 to 18 drops from a fine tipped glass pipette). Samples were placed 5 inches from the center of a Bull Dog Halogen lamp for 45 minutes. Samples were then moved into the 120° F. walk-in oven for 2 hours. Subsequently, samples were moved into the hood to reach room temperature, and the samples were weighted before testing.

Preparing Pine Sap Glass Slides

For pure fresh resin, trees were cut and harvested the next day. A tree sap solution was prepared by blending ten parts (by wt) tree resin with one part of re-entry N solvent for 20 minutes at a temperature sufficient to just melt the resin solvent mixture without boiling. The liquid mixture was transferred to a filter funnel to filter out any solid materials.

Measurements of 9 mm from the bottom of a 22 mm by 22 mm glass cover slip were marked on both sides with a fine tip sharpie and a reference number in the corner. Each cover slip was weighed on an analytical balance, and the mass was recorded. Electrical tape was laid across the glass slide so the bottom of the tape meets at the 9 mm mark on both sides of the slide. Lay electrical tap across the glass slide so the top of the tape meets at the 2 mm mark on both sides of the slide. The pine sap was pipetted onto the left side of the slide, and the pine sap was squeegeed over from left to right, leaving a smooth even coating of pine sap. Samples were placed 5 inches from the center of a Bull Dog Halogen lamp for 45 minutes. Samples were then moved into the 120° F. walk-in oven for 2 hours. Subsequently, samples were moved into the hood to reach room temperature, and the samples were weighted before testing.

K12 Contact Angle Measuring System Procedure

The K12 Contact Angle Measuring System (Krüss GmbH, Hamburg, Germany) was used to measure the contact angles of various windshield washer fluids made with the cricket slurry on the cover slips. The K-12 system provided a constant cycle or "dip" rate for the substrate (i.e., fluid contacting the bug guts).

Statistical Validation

To provide validation to the statistical methods that were utilized, preliminary testing was conducted to a) assess the variability in the K12 testing method, including slide preparation and soil uniformity, and b) to determine how long cricket samples that were intended for use with the k-12 tensiometer testing were viable for. Slide soil weights were analyzed using probability plots and Anderson Darling test for assessing the normalcy of the data and boxplots for repeatability analysis and defining an acceptable normal range for soil weight on the slides.

Results:

The formulation of Example 1 successfully removed bug guts (Table 6) as effectively or better than other windshield fluid compositions (Tables 1-5). Graphically, this can be viewed at FIG. 1.

TABLE 1

| Composition A [1] | | | | | (grams) |
|---|---|---|---|---|---|
| Tile | Before App | After App | Diff | After Test | Bug Guts Removed |
| 66 | 0.1790 | 0.1889 | 0.0099 | 0.1844 | 0.0045 |
| 68 | 0.1973 | 0.2069 | 0.0096 | 0.2034 | 0.0035 |
| 69 | 0.1842 | 0.1941 | 0.0099 | 0.1897 | 0.0044 |
| 70 | 0.1736 | 0.1845 | 0.0109 | 0.1801 | 0.0044 |
| 71 | 0.1775 | 0.1866 | 0.0091 | 0.1828 | 0.0038 |
| 72 | 0.1841 | 0.1940 | 0.0099 | 0.1897 | 0.0043 |
| 73 | 0.1752 | 0.1860 | 0.0108 | 0.1820 | 0.0040 |
| 74 | 0.1850 | 0.1965 | 0.0115 | 0.1921 | 0.0044 |
| 75 | 0.1836 | 0.1945 | 0.0109 | 0.1903 | 0.0042 |
| 76 | 0.1815 | 0.1887 | 0.0072 | 0.1857 | 0.0030 |

[1] Composition A is a washer fluid comprising water, siloxanes, and a surfactant blend.

TABLE 2

| Prestone ® Bug Wash ® | | | | | (grams) |
|---|---|---|---|---|---|
| Tile | Before App | After App | Diff | After Test | Bug Guts Removed |
| 77 | 0.1757 | 0.1846 | 0.0089 | 0.1791 | 0.0055 |
| 78 | 0.1898 | 0.1997 | 0.0099 | 0.1904 | 0.0093 |
| 79 | 0.1863 | 0.1983 | 0.0120 | 0.1876 | 0.0107 |
| 80 | 0.1795 | 0.1918 | 0.0123 | 0.1796 | 0.0122 |
| 81 | 0.1905 | 0.2027 | 0.0122 | 0.1903 | 0.0124 |
| 82 | 0.1822 | 0.1931 | 0.0109 | 0.1822 | 0.0109 |
| 83 | 0.1788 | 0.1900 | 0.0112 | 0.1789 | 0.0111 |
| 84 | 0.1822 | 0.1936 | 0.0114 | 0.1821 | 0.0115 |
| 86 | 0.1783 | 0.1896 | 0.0113 | 0.1786 | 0.0110 |
| 87 | 0.1795 | 0.1923 | 0.0128 | 0.1795 | 0.0128 |

TABLE 3

| Prestone ® Bug Wash ® without 1-amino-2-propanol | | | | | (Grams) |
|---|---|---|---|---|---|
| Tile | Before App | After App | Diff | After Test | Bug Guts Removed |
| 57 | 0.1908 | 0.2000 | 0.0092 | 0.1930 | 0.0070 |
| 58 | 0.1840 | 0.1947 | 0.0107 | 0.1836 | 0.0111 |
| 59 | 0.1776 | 0.1865 | 0.0089 | 0.1783 | 0.0082 |
| 60 | 0.1903 | 0.2024 | 0.0121 | 0.1921 | 0.0103 |
| 61 | 0.1777 | 0.1882 | 0.0105 | 0.1813 | 0.0069 |
| 62 | 0.1796 | 0.1931 | 0.0135 | 0.1854 | 0.0077 |
| 63 | 0.1909 | 0.1989 | 0.0080 | 0.1906 | 0.0083 |
| 64 | 0.1837 | 0.1955 | 0.0118 | 0.1836 | 0.0119 |
| 88 | 0.1811 | 0.1922 | 0.0111 | 0.1848 | 0.0074 |
| 89 | 0.1887 | 0.1998 | 0.0111 | 0.1885 | 0.0113 |

TABLE 4

| Compostion B[2] | | | | | (grams) |
|---|---|---|---|---|---|
| Tile | Before App | After App | Diff | After Test | Bug Guts Removed |
| 90 | 0.1750 | 0.1837 | 0.0087 | 0.1803 | 0.0034 |
| 91 | 0.1799 | 0.1935 | 0.0136 | 0.1881 | 0.0054 |
| 92 | 0.1852 | 0.1953 | 0.0101 | 0.1911 | 0.0042 |
| 93 | 0.1826 | 0.1952 | 0.0126 | 0.1906 | 0.0046 |
| 94 | 0.1810 | 0.1939 | 0.0129 | 0.1894 | 0.0045 |
| 95 | 0.1773 | 0.1883 | 0.0110 | 0.1845 | 0.0038 |
| 96 | 0.1877 | 0.1988 | 0.0111 | 0.1949 | 0.0039 |
| 97 | 0.1803 | 0.1924 | 0.0121 | 0.1879 | 0.0045 |
| 98 | 0.1806 | 0.1927 | 0.0121 | 0.1885 | 0.0042 |
| 99 | 0.1775 | 0.1905 | 0.0130 | 0.1857 | 0.0048 |

[2]Composition B is a washer fluid comprising water, butyl cellosolve, and siloxanes.

TABLE 5

| Composition C[3] | | | | | (grams) |
|---|---|---|---|---|---|
| Tile | Before App | After App | Diff | After Test | Bug Guts Removed |
| 100 | 0.1787 | 0.1902 | 0.0115 | 0.1802 | 0.01 |
| 101 | 0.1802 | 0.1921 | 0.0119 | 0.1823 | 0.0098 |
| 102 | 0.1826 | 0.1936 | 0.0110 | 0.1828 | 0.0108 |
| 103 | 0.1793 | 0.1903 | 0.0110 | 0.1792 | 0.0111 |
| 104 | 0.1779 | 0.1884 | 0.0105 | 0.1771 | 0.0113 |
| 105 | 0.1819 | 0.1936 | 0.0117 | 0.1820 | 0.0116 |
| 1 | 0.1839 | 0.1940 | 0.0101 | 0.1839 | 0.0101 |
| 2 | 0.1866 | 0.1968 | 0.0102 | 0.1869 | 0.0099 |
| 3 | 0.1920 | 0.2019 | 0.0099 | 0.1920 | 0.0099 |
| 4 | 0.1812 | 0.1914 | 0.0102 | 0.1812 | 0.0102 |

[3]Composition C is a washer fluid extremely similar to the Prestone ® Bug Wash ® comprising water, ammonium hydroxide, Dowanol ® DPM, and a surfactant blend.

TABLE 6

| Example 1 Formulation | | | | | (grams) |
|---|---|---|---|---|---|
| Tile | Before App | After App | Diff | After Test | Bug Guts Removed |
| 16 | 0.1799 | 0.1904 | 0.0105 | 0.1796 | 0.0108 |
| 17 | 0.1842 | 0.1944 | 0.0102 | 0.1837 | 0.0107 |
| 18 | 0.1798 | 0.19 | 0.0102 | 0.1793 | 0.0107 |
| 19 | 0.1881 | 0.199 | 0.0109 | 0.1877 | 0.0113 |
| 20 | 0.1789 | 0.1891 | 0.0102 | 0.1782 | 0.0109 |
| 21 | 0.1786 | 0.1904 | 0.0118 | 0.1779 | 0.0125 |
| 22 | 0.19 | 0.2008 | 0.0108 | 0.1896 | 0.0112 |
| 24 | 0.1766 | 0.187 | 0.0104 | 0.1759 | 0.0111 |
| 25 | 0.1943 | 0.2056 | 0.0113 | 0.1937 | 0.0119 |
| 26 | 0.1858 | 0.1942 | 0.0084 | 0.1848 | 0.0094 |

Example 3

Windshield Test Apparatus

The Windshield test apparatus allows for a quantitative evaluation of streaking. Since the samples are not dried, there is no need to assess variability that may occur due to soil changes over time. However, the same batch of bug guts will be used across each of the windshield products to limit any batch to batch variation. As during normal use, the fluid was used 5 times on the windshield and allowed to dry before application of the bugs.

Cleaning Procedure

In succession, windshields were wiped down with an alconox solution, mineral spirits, and then with isopropyl alcohol. The windshield washer fluid reservoir was then thoroughly rinsed with tap water, and the washer motor flush was activated. Subsequently, the reservoir was rinsed using deionized water, and the washer motor was activated to flush the reservoir. Following this cleaning procedure, the reservoir was double rinsed using the product that was tested.

Cricket Slurry Preparation

The cricket slurry was prepared as described in Example 2.

Pine Sap Preparation

Pine sap was prepared as described in Example 2.

Cricket Slurry and Pine Sap Windshield Application

A windshield was placed on a flat surface before beginning cricket slurry application. Above the pivot point of the wiper, five equally distant points were measured and marked on the windshield (all marks came in contact with the washer fluid and wiper blade). Using a hole punch, holes were put in electrical tape, and the open circle was placed over the marked locations. One drop of cricket slurry or pine sap was applied via a pipette to each circle in the electrical tape. Each piece of electrical tape was wiped with a squeegee to remove any excess beyond the layer of cricket slurry or pine sap as thick as the tape. Then the electrical tape was immediately removed. A Bull Dog Halogen lamp was placed over the windshield (approximately 2 feet away) for 30 minutes. While the sample was drying, the windshield washer fluid reservoir was thoroughly rinsed out following the aforementioned procedure. After 30 minutes, the windshield was mounted to the test stand and photographed. A new wiper blade was attached, and both the wiper blade and the washer fluid were activated for 5 seconds simultaneously. The wiper was allowed to continue for an additional two wipes after the initial 5 seconds to remove excess washer fluid. After photographing the windshield, the length of each streak remaining on the window was measured.

Results

The formulation of Example 1 removed 100% of the bug soils on the windshield. There was no streaking of either the bug soil or streaking or hazing of the fluid itself.

Example 4

K-12 Tensiometer Adhesion Testing

In order to demonstrate a product's ability to stop bugs from forming a bond with windshield glass, a pretreatment of product must be applied to a windshield first. This is accomplished through close approximation of how the product would be used on a vehicle.

Method

A glass slide was prepared by spraying a fluid (water or the formulation of Example 1) and wiping clean with a small piece of windshield wiper. This was repeated for 10 applications. Bugs were then applied to the slide in the same method as described in Example 2. Photographs of the bug slides using both water and the formulation described in Example 2.

Results

Figure 2:
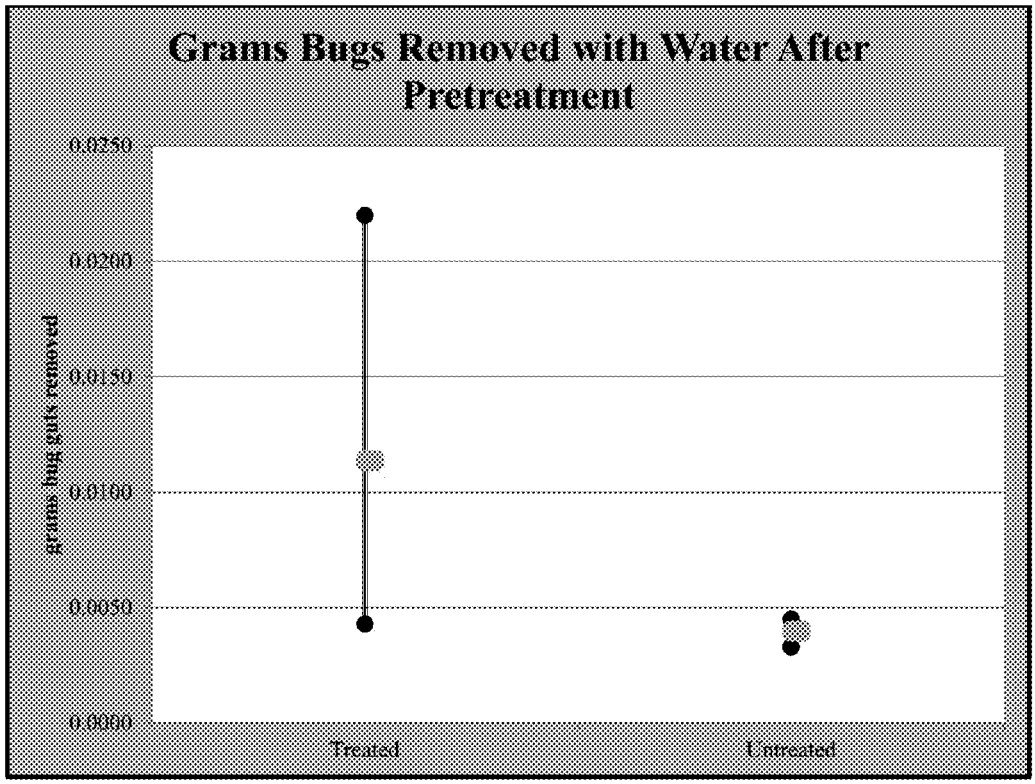
FIG. 2. shows the grams of bug guts removed with water from pretreated and untreated glass.

On the water treated slides, the bugs formed a strong bond to the glass. On the slide pretreated with the formulation of Example 1, the bugs did not form any bond to the glass and were pealing up. The treated and untreated slides were tested according to the K-12 Bench Test procedure described in Example 2, but water was used instead of windshield washer fluid. Data from this testing are shown in Tables 7 and 8. These data show a significant increase in the amount of bugs removed even with water used as the cleaning agent on the pretreated slides (FIG. 2).

TABLE 7

| | Untreated Slides, Water Cleaned | | | | (grams) |
|---|---|---|---|---|---|
| Tile | Before App | After App | Diff | After Test | Guts Removed |
| 27 | 0.1743 | 0.1845 | 0.0102 | 0.1802 | 0.0043 |
| 28 | 0.1789 | 0.1893 | 0.0104 | 0.1855 | 0.0038 |
| 29 | 0.1790 | 0.1871 | 0.0081 | 0.1826 | 0.0045 |
| 30 | 0.1800 | 0.1906 | 0.0106 | 0.1873 | 0.0033 |
| 31 | 0.1776 | 0.1872 | 0.0096 | 0.1833 | 0.0039 |
| 32 | 0.1736 | 0.1841 | 0.0105 | 0.1798 | 0.0043 |
| 33 | 0.1769 | 0.1862 | 0.0093 | 0.1823 | 0.0039 |
| 34 | 0.1741 | 0.1841 | 0.0100 | 0.1801 | 0.0040 |
| 35 | 0.1777 | 0.1872 | 0.0095 | 0.1831 | 0.0041 |
| 36 | 0.1785 | 0.1891 | 0.0106 | 0.1854 | 0.0037 |

TABLE 8

| | Treated Slides, Water Cleaned | | | | (grams) |
|---|---|---|---|---|---|
| Tile | Before App | After App | Diff | After Test | Guts Removed |
| 1 | 0.1748 | 0.1849 | 0.0101 | 0.1804 | 0.0045 |
| 2 | 0.1744 | 0.1846 | 0.0102 | 0.1802 | 0.0044 |
| 3 | 0.1786 | 0.1898 | 0.0112 | 0.1855 | 0.0043 |
| 4 | 0.1735 | 0.1924 | 0.0189 | 0.1869 | 0.0055 |
| 5 | 0.1769 | 0.1845 | 0.0076 | 0.1801 | 0.0044 |
| 6 | 0.1729 | 0.2007 | 0.0278 | 0.1889 | 0.0118 |
| 7 | 0.1749 | 0.2069 | 0.0320 | 0.1937 | 0.0132 |
| 8 | 0.1749 | 0.2020 | 0.0271 | 0.1800 | 0.0220 |
| 9 | 0.1754 | 0.2047 | 0.0293 | 0.1829 | 0.0218 |
| 10 | 0.1741 | 0.2031 | 0.0290 | 0.1813 | 0.0218 |

Thereby, the formulation of Example 1 forms a barrier to inhibit bonding to the glass. Since the formulation of Example 1 inhibits bonding to the glass, streaking is prevented or reduced.

Example 5

Windshield Test Stand Apparatus Adhesion Testing

The windshield test stand apparatus was thoroughly cleaned and bugs were applied according to the method found in Example 2. The cleaning procedure was followed and photographs were taken before and after the cleaning procedure. The Windshield was again cleaned and pretreated with the formulation of Example 1. Pretreatment of the windshield was accomplished by using the formulation of Example 1 sprayed 6 times through the windshield wiper sprayer and activating the windshield wipers 3 times after each application (standard in vehicles when using windshield washer fluid).

Results:

Without pretreatment, water only provided an estimated 25% removal of bug soils with severe streaking. However, water provided an estimated 90% removal of bug soils without streaking on a windshield pretreated with the formulation of Example 1. These data further indicate that the formulation of Example 1 formed a barrier on the windshield. This barrier inhibited bug soils from bonding to the windshield.

Example 6

Goniometer Contact Angle Testing

In order to determine the ability of fluids to cause water to bead on a windshield (water repellency), sections of cut, flat windshield glass were used as a surface to test contact angle between the glass and drops of water using a Goniometer.

Methods

Figure 3:
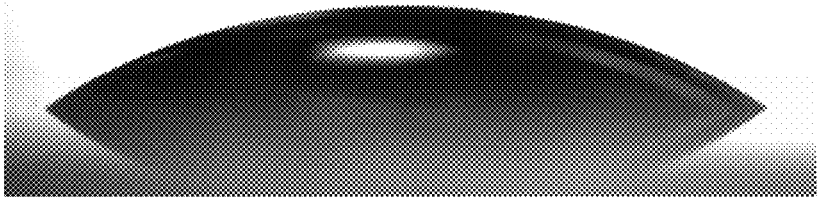
FIG. 3 is a photograph of water beading on untreated, flat windshield glass.

Testing was performed with glass that was untreated or pretreated with the formulation of Example 1. Ten applications for both untreated and pretreated glass were tested, where each application simulated a single usage of the windshield wiper fluid for 3 sprays and wipes. After application, the glass was allowed to dry, a drop of water was added to the surface, and the contact angle was measured. Data and photographs of the water droplets can be found in Tables 9-10 and FIGS. 3-4, respectively.

Results

Figure 4:
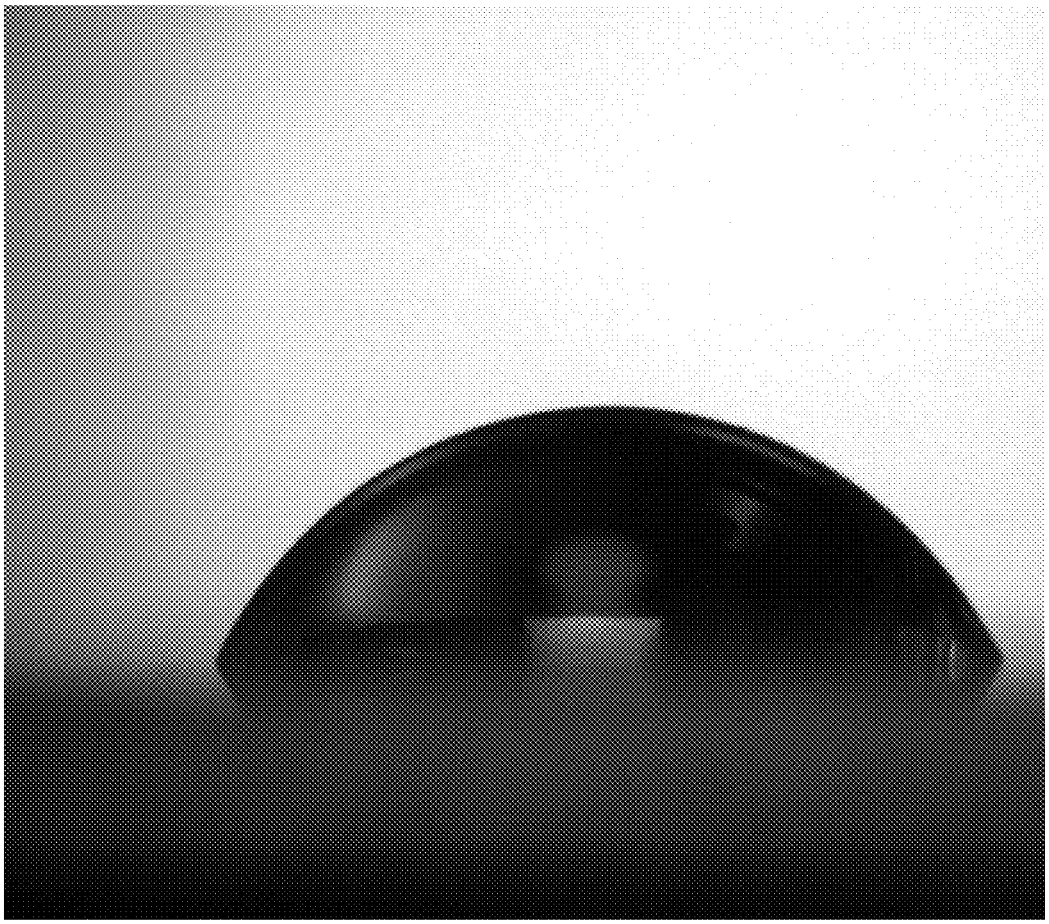
FIG. 4 is a photograph of water beading on flat windshield glass pretreated with the formulation of Example 1.

An increase in contact angle from 68° to 78° shows that water beading is occurring by creating a thin hydrophobic layer on the windshield. The formulation of Example 1 accomplished water beading without streaking or hazing of the windshield. This formulation causes greater contact angles therefore better beading. FIG. 4 showed the significance of this change in contact angle as demonstrated by the height of the water droplet.

TABLE 9

| Untreated Slide (Control) | | | | | | | | |
|---|---|---|---|---|---|---|---|---|
| Liquid | Solid | Run | No. | Left | Right | Mean | Height | Width |
| Water | Glass | Water | 1 | 69.00 | 68.20 | 68.60 | 1.38 | 4.402 |
| Water | Glass | Water | 2 | 69.00 | 68.20 | 68.60 | 1.38 | 4.402 |
| Water | Glass | Water | 3 | 69.00 | 68.20 | 68.60 | 1.38 | 4.402 |

TABLE 10

| Slide Treated with Formulation of Example 1 | | | | | | | | |
|---|---|---|---|---|---|---|---|---|
| Liquid | Solid | Run | No. | Left | Right | Mean | Height | Width |
| Water | Glass | Water | 1 | 80.7 | 77.2 | 78.9 | 0.257 | 4.094 |
| Water | Glass | Water | 2 | 79.3 | 77.2 | 78.3 | 0.255 | 4.094 |
| Water | Glass | Water | 3 | 79.6 | 77.8 | 78.7 | 0.255 | 4.094 |

The invention claimed is:

1. A cleaning composition comprising:
at least one surfactant;
an ammonia compound;
a water dispersible alkylamino, polyalkyleneoxide modified silicone terpolymer; and
water.

2. The cleaning composition of claim 1 further comprising one or more additives.

3. The cleaning composition of claim 2, wherein the additive is a fragrance, a dye, or both a fragrance and a dye.

4. The cleaning composition of claim 1 further comprising at least one alcohol.

5. The cleaning composition of claim 1, wherein the cleaning composition lacks alcohol.

6. The cleaning composition of claim 4, wherein the at least one alcohol is about 42 wt % or less.

7. The cleaning composition of claim 6, wherein zero to about 37% of the alcohol is a freezing point depressant.

8. The cleaning composition of claim 7, wherein the freezing point depressant is ethylene glycol or propylene glycol.

9. The cleaning composition of claim 4, wherein the at least one alcohol is selected from the group consisting of methanol; ethanol; propanol; butanol; furfurol; furfuryl alcohol; tetrahydrofurfuryl alcohol; ethoxylated furfuryl alcohol; ethylene glycol; propylene glycol; 1,3-propanediol; glycerol; diethylene glycol; triethylene glycol; 1,2-propylene glycol; 1,3-propylene glycol; dipropylene glycol; butylene glycol; glycerol-1,2-dimethyl ether; glycerol-1,3-dimethyl ether; monoethylether of glycerol; sorbitol; 1,2,6-hexanetriol; trimethylolpropane; methoxyethanol; and combinations thereof.

10. The cleaning composition of claim 1, wherein the water dispersible alkylamino, polyalkyleneoxide modified silicone terpolymer is about 0.001 wt % to about 0.2 wt %.

11. A cleaning composition comprising:
a) about 98 wt % to about 99.9 wt % water;
b) about 0.006 wt % to about 0.6 wt % of a surfactant or a surfactant mixture;
c) zero to about 0.12 wt % fragrance;
d) zero to about 0.004 wt % dye;
e) about 0.1 wt % to about 0.5 wt % ammonia compound; and
f) about 0.025 wt % to about 0.2 wt % water dispersible alkylamino, polyalkyleneoxide modified silicone terpolymer.

12. A method of cleaning a hard surface comprising wiping the hard surface with a cleaning composition comprising at least one surfactant; an ammonia compound; a water dispersible alkylamino, polyalkyleneoxide modified silicone terpolymer; and water.

13. The method of claim 12 further comprising rinsing the hard surface with a liquid after.

14. A method of preventing attachment of bugs, dirt, or avian feces to a hard surface comprising pretreating the hard surf ace with a cleaning composition comprising at least one surfactant; an ammonia compound; a water dispersible alkylamino, polyalkyleneoxide modified silicone terpolymer; and water.

15. The method of claim 14, wherein a mean contact angle with a droplet of water is at least 78 degrees on the pretreated hard surface.

16. A method of producing a cleaning composition comprising diluting a cleaning composition concentrate, wherein a diluted cleaning composition comprises about 62 wt % to about 99.98 wt % water; about 0.005 wt % to about 0.5 wt % of a surfactant or surfactant mixture; zero to about 0.2 wt % of fragrance; zero to about 0.1 wt % of a dye; about 0.005 wt % to about 1 wt % of an ammonia compound; about 0.01 wt % to about 0.5 wt % of a water-dispersible alkyl amino, polyalkyleneoxide modified silicone terpolymer; and zero to about 42 wt % of at least one alcohol.

17. The cleaning composition of claim 11 further comprising at least one alcohol.

18. The cleaning composition of claim 11, wherein the cleaning composition lacks alcohol.

19. The cleaning composition of claim 17, wherein the at least one alcohol is about 42 wt % or less.

20. The cleaning composition of claim 19, wherein zero to about 37% of the alcohol is a freezing point depressant.

21. The cleaning composition of claim 1 wherein the water dispersible alkylamino, polyalkyleneoxide modified silicone terpolymer is present in an amount ranging from about 0.001 wt % to about 0.1 wt %.

22. The cleaning composition of claim 21 wherein the water is present in an amount ranging from about 99.0 wt % to about 99.9 wt %.

23. The cleaning composition of claim 21 wherein the ammonia compound is present in an amount ranging from about 0.01 wt % to about 0.4 wt %.

24. The cleaning composition of claim 21 wherein the at least one surfactant is present in an amount ranging from about 0.001 wt % to about 0.1 wt %.

25. A cleaning composition comprising:

a) water in an amount ranging from about 99.1 wt % to about 99.9 wt %;

b) at least one surfactant in an amount ranging from about 0.001 wt % to about 0.075 wt %;

c) an ammonia compound in an amount ranging from about 0.05 wt % to about 0.4 wt %; and d) a water dispersible alkylamino, polyalkyleneoxide modified silicone terpolymer present in an amount ranging from about 0.001 wt % to about 0.075 wt %.

* * * * *